United States Patent [19]

Calvert

[11] 4,204,376

[45] May 27, 1980

[54] MOLDINGS FOR ARTICLES

[75] Inventor: Scott A. Calvert, Granville, Ohio

[73] Assignee: Owens-Corning Fiberglas Corporation, Toledo, Ohio

[21] Appl. No.: 924,605

[22] Filed: Jul. 14, 1978

[51] Int. Cl.[2] ..... E04F 19/02

[52] U.S. Cl. ..... 52/309.1; 52/35; 52/287; 52/717; 52/718

[58] Field of Search ..... 52/287, 288, 290, 716, 52/34, 35, 309.1, 717, 718

[56] References Cited

U.S. PATENT DOCUMENTS 3,568,386 3/1971 Gossen ..... 52/288

FOREIGN PATENT DOCUMENTS 2011205 9/1970 Fed. Rep. of Germany ..... 52/290

215826 10/1967 Sweden ..... 52/288

*Primary Examiner*—Alfred C. Perham

*Attorney, Agent, or Firm*—Ronald C. Hudgens; Philip R. Cloutier; Greg Dziegielewski

[57] ABSTRACT

A finishing strip or molding adapted to engage a wall and an article having a flange adapted to be secured to the wall comprising: a first rigid section having a channeled portion adapted to engage said flange such that a portion of the channeled section is positioned between the wall and the flange; a second rigid section having at least one projection adapted to limit the relative spacing between said first section and said second section, said second section having an extended portion having a tab adapted to engage an ear projecting from said channeled portion of said first section to fixedly position said first section with respect to said second section; a first flexible section jointed to said first rigid section and second rigid section adapted to permit relative movement between the first and second rigid sections; and a second flexible section projecting from said second rigid section a predetermined distance sufficient to contact the wall when said finishing strip is installed and in the closed position.

7 Claims, 3 Drawing Figures

MOLDINGS FOR ARTICLES

BACKGROUND OF THE INVENTION

When installing an article such as a tub/shower unit or vanity or the like, it is generally necessary to form an aesthetically pleasing joint between the article and the wall. In some instances, the article is fastened directly to the bare studs of the wall by means of a flange before the sheets of dry wall and the like are installed. In such instances, the dry wall is generally positioned to cover the flange projection outwardly from the perimeter of the article.

However, in some instances, the wall is at least partially finished, that is, the wall board or dry wall may be installed prior to fastening the article to the wall. Thus, other measures are necessary to hide the flange which is used to attach the article to the wall.

Historically, such moldings or trim have been installed after the article or item has been previously fastened to the wall by (1) fastening the article to the wall and (2) fastening the molding or finishing strip to the wall or article at the junction of the wall and article. Obviously a labor intensive operation

SUMMARY OF THE INVENTION

This invention, a finishing strip or molding adapted to engage a wall and an article having a flange adapted to be secured to the wall is comprised of: a first rigid section having a channeled portion adapted to engage said flange such that a portion of the channeled section is positioned between the wall and the flange; a second rigid section having at least one projection adapted to limit the relative spacing between said first section and said section, said second second section having an extended portion having a tab adapted to engage an ear projecting from said channeled portion of said first section to fixedly position said first section with respect to said second section; a first flexible section joined to said first rigid section and second rigid section adapted to permit relative movement between the first and second rigid sections; and a second flexible section projecting from said second rigid section a predetermined distance sufficient to contact the wall when said finishing strip is installed and in the closed position.

Therefore, it is an object of this invention to provide a finishing strip which is aesthetically pleasing and permits the article and finishing strip to be fastened to the wall in one operation employing the same fasteners.

An additional object of this invention is to provide a finishing strip wherein the exposed surfaces are generally in a predetermined orientation dispite variations in flange thickness from article to article.

Other objects and advantages of this invention will be obvious and explained by reference to the accompanying specification and drawings.

DESCRIPTION OF THE INVENTION

Figure 1:
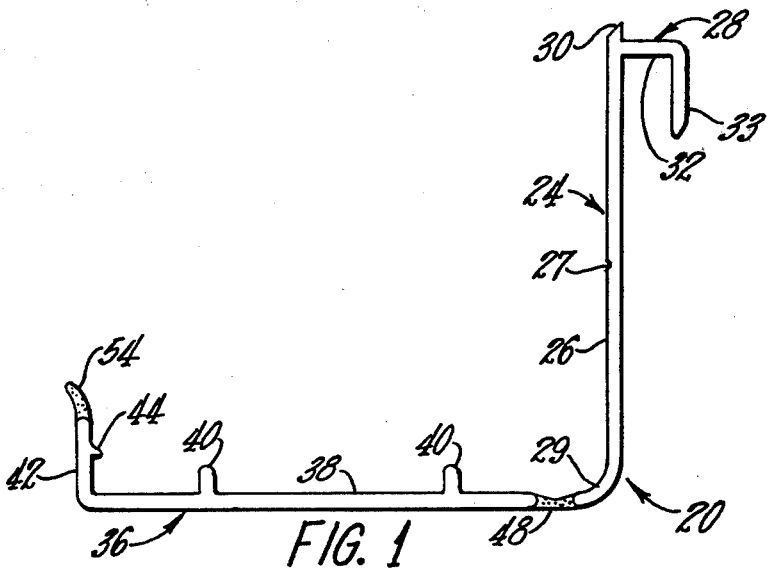
FIG. 1 is a cross-sectional view of the finishing strip according to this invention.
Figure 2:
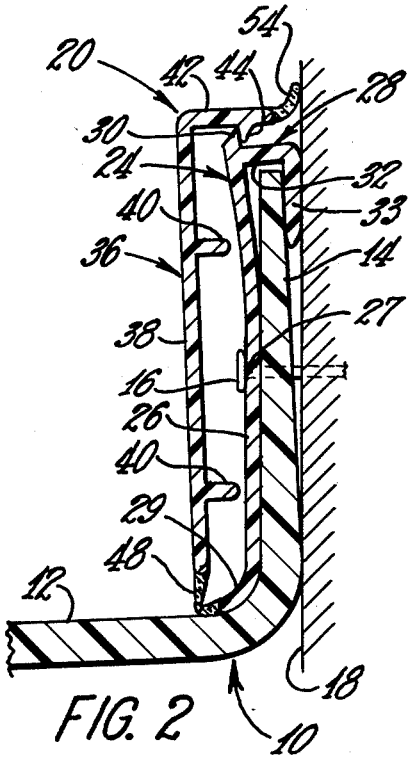
FIG. 2 is a cross-sectional view of a flanged article with the finishing strip installed and closed, the flange being of a first thickness.
Figure 3:
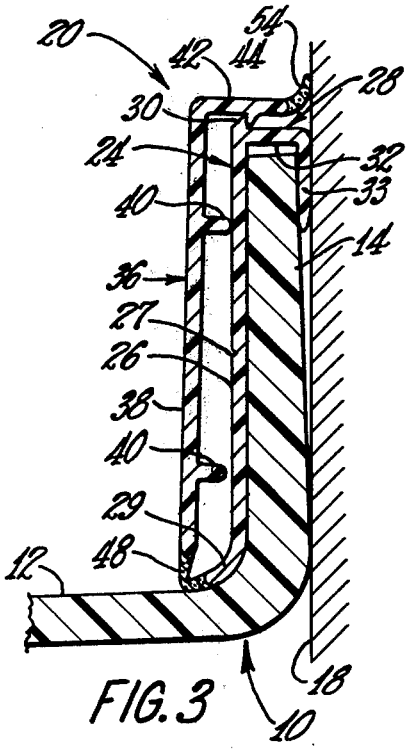
FIG. 3 is a cross-sectional view similar to that in FIG. 2 depicting the orientation of the finishing strip when the flange of the article is of a greater thickness.

As shown in FIGS. 1, 2 and 3, article 10, such as a commercially available tub/shower unit, having a flange 14 extending outwardly from the periphery of upstanding member 12 is positioned against wall 18. The finishing strip 20 and flange 14 are held in place by means of a fastener, such as a nail or screw 16.

Item or finishing strip 20 is comprised of first and second rigid sections 24 and 36 and first and second flexible sections 48 and 54. First rigid section 24 is comprised of a main portion 26, a channeled portion 28 at one end of the main portion 26 and an ear 30 substantially co-planar with the main portion 26 projecting beyond channeled portion 28. The channeled portion 28 consists of a first leg 32 joined to main portion 26 oriented substantially transversely thereto and a second leg 33 which is substantially parallel to main portion 26, joined to first leg 32. When installed, second leg 33 is positioned between wall 18 and flange 14 to locate said finishing strip at least during the fastening operation.

The second rigid section 36 is comprised of a main body 38 having at least one projection 40, and preferably two, extending inwardly towards the first rigid section when the finishing strip is in the closed position to maintain a predetermined space between said main portion 26 and main body 38. Furthermore, the second rigid section includes an extended portion 42 at one end of the main body 38 oriented substantially transversely with respect thereto, said extended portion 42 having a beveled tab 44 adapted to engage the ear 30 of first section 24 to fixedly position said first and second sections with respect to each other. Ear 30 and tab 44 function as a means for latching or holding the first and second rigid sections in position with respect to each other.

The first flexible section is joined to the first rigid section at the end of main portion 26 opposite the channeled portion 28, and the first flexible section 48 is joined to the main body 38 of second rigid section 36 at the end opposite extended portion 42. The first flexible section 48 can be designed to contact the upstanding portion 12 of article 10 when installed to form a seal against ambient liquid penetration between the upstanding member 12 and the first flexible section 48.

The second flexible section 54 projects from said extended portion 42 of the second section 36 a predetermined distance sufficient to contact wall 18 when the finishing strip is installed and in the closed as shown in FIGS. 2 and 3 to form a seal against ambient liquid penetration between article 10 and wall 18.

At installation article 10 is generally positioned at the wall 18 and the finishing strip 20 is slid into position with second leg 33 of the channeled portion 28 located between the wall 18 and the outer edge of flange 14. The finishing strip will be in the open position as shown in FIG. 1. Tip of fastener 16 can be located in groove 27 in first rigid section 24 for ease of installation. Groove 27 is generally located at approximately the midpoint of first rigid section 24 and extends along the length thereof. Once a suitable number of fasteners 16 have been driven through the first rigid section 24 and flange 14 into wall 18, the second rigid section 36 can be folded over to the closed position such that the beveled ear 30 and beveled tab 44 are brought into locking engagement along the length thereof as shown in FIGS. 2 and 3.

As can be seen from FIGS. 2 and 3, the second rigid section 36 and second flexible section 54 retain the same general orientation with respect to wall 18 despite allowable variations in thickness of the flange 14. That is, second rigid section 36 remains approximately parallel to the wall 18 while the extended portion 42 remains approximately perpendicular to the wall 18.

In the absence of channeled portion 28 and projection 40, the extended portion 42 can exhibit a tendency to become angled obliquely with respect to the wall rather than being substantially square thereto.

To provide an effective seal against ambient (i.e., free standing water and the like) liquids, it is believed that the extended portion should remain relatively square with respect to the wall to provide sealing contact between the second flexible 54 and the wall 18 while maintaining an esthetically pleasing appearance.

Any suitable polymeric material, such as polyvinyl chloride, can be employed as the first and second rigid and flexible sections according to this invention. Polyvinyl chloride, or P.V.C., is preferred for situations where the finishing strip will be employed in a bathroom along the edge of the tub or shower or the like. The rigid sections 24 and 36, similar to well known P.V.C. pipe, have a hardness from about 75 Shore on the D scale to about 8 Shore on the D scale, with a hardness or resilience of 79 to 80 Shore on the D scale being preferred. A suitable material for the rigid sections is available from the Ethyl Corporation of Richmond, Virginia, as P.V.C. compound number 7045-243. As is well known in the art, additives may be employed to modify the color of P.V.C.

The flexible sections 48 and 54 can be a plasticized P.V.C., well known in the art. The flexible sections can have a hardness or resilience from about 67 on the Shore A scale to about 77 on the Shore A scale, with a hardness from about 69 to 75 on the Shore A scale. A rotatable plasticized P.V.C. compound is available from B. F. Goodrich as Flexible Geon compound No. 83741.

The finishing strip 20 can be extruded using commercially available technology. The flexible and rigid sections are extruded simultaneously through a common exit port in a die to produce a unitary structure having the flexible and rigid sections joined or fused together in a continuous length. The finishing stip 20, that can be co-extruded as is known in the art or can be formed employing the dual durometer extrusion process of the Crane Plastics Corporation of Columbus, Ohio.

The rigid sections should be stiff enough to maintain their general configuration while in use as a molding or trim around a tub or shower unit. The flexible sections 38 and 54 should be pliable enough to conform to minor variations in the surface of the wall to form a water proof seal against free standing water inherently splashed about bathrooms and the like.

Obviously, the flange 14 must be of the type extending outwardly from the article along the wall supporting it. Also, the flange must be of a thickness within a predetermined range to enable the channeled portion 28 to suitably engage or receive the tip of the flange as shown in FIGS. 2 and 3.

From FIGS. 2 and 3 it can be seen that the curved portion 29 of main portions 26 opposite the end continuous with the channeled portion 28 has an outer radius approximately equal to the radius of the fillet formed between the flange and the upstanding member of the article. Or, the curved portion 29 be formed entirely of the flexible P.V.C. compound to insure conformity between the finishing strip and the article at that point.

It is apparent that, within the scope of the invention, modifications and different arrangements can be made other than as is herein disclosed. The present disclosure is merely illustrative with the invention comprehending all variations thereof.

I claim:

1. A finishing strip adapted to engage a wall and an article having a flange adapted to be secured to the wall comprising:

a first rigid section having a channeled portion adapted to engage said flange such that at least part of the channeled portion is positioned between the wall and the flange;

a second rigid section having at least one projection adapted to limit the relative spacing between said first section and second section, said second section having an extended portion having a tab adapted to engage an ear projecting from said first section to fixedly position said first section with respect to said second section;

a first flexible section joined to said first rigid section and said second rigid section adapted to permit relative movement between said first and second sections; and a second flexible section projecting from said second rigid section a predetermined distance sufficient to contact the wall when said finishing strip is in the closed position.

2. A finishing strip adapted to engage a wall and an article having an upstanding portion and a flange adapted to be fastened to the wall comprising:

a first rigid section having a main portion, a channeled portion at one end of said main portion and an ear projecting beyond said channeled portion, said channeled portion being adapted to be positioned between the wall and the flange;

a second rigid section having a main body having at least one projection adapted to maintain a predetermined space between said first and second rigid sections and having an extended portion at one end of said main body oriented substantially transversely with respect to said main body, said extended portion having a tab adapted to engage said ear of said first section to fixedly position said first section with respect to said second section;

a first flexible section joined to said first and second rigid sections, said first flexible section being joined to said first rigid section at the end of said main portion of said first rigid section opposite said channeled portion, said first flexible section being joined to said main body of said second section at the end of said main body opposite said extended portion; said first flexible section being adapted to contact the upstanding portion of the article when installed; and a second flexible section projecting from said extended portion of said second rigid section a predetermined distance sufficient to contact the wall when said finishing strip is installed and in the closed position.

3. The finishing strip of claims 1 or 2 wherein said first and second flexible and rigid sections are a P.V.C. material.

4. The finishing strip of claims 1 or 2 wherein said first and second rigid sections are a polymer having a resilience from about 75 Shore D to about 85 Shore D, and wherein said first and second flexible sections have a resilience from about 67 Shore A to about 77 Shore A.

5. The finishing strip of claim 4 wherein said first and second rigid sections have a resilience from about 79 Shore D to about 80 Shore D.

6. The finishing strip of claim 5 wherein said first and second flexible sections have a resilience from about 69 Shore A to about 75 Shore A.

7. The finishing strip of claims 1 or 2 wherein said first and second rigid and flexible sections are co-extruded to produce a unitary structure.

* * * * *